US005452995A

United States Patent [19]

Izumi et al.

[11] Patent Number: 5,452,995

[45] Date of Patent: Sep. 26, 1995

[54] SCROLL TYPE REFRIGERANT COMPRESSOR WITH MEANS FOR PREVENTING UNCONTROLLED MOVEMENT OF A DRIVE BUSHING

[75] Inventors: Yuji Izumi; Yasushi Watanabe; Masao Iguchi; Izuru Shimizu, all of Kariya, Japan

[73] Assignee: Kabushiki Kaisha Toyoda Jidoshokki Seisakusho, Aichi, Japan

[21] Appl. No.: 153,291

[22] Filed: Nov. 16, 1993

[30] Foreign Application Priority Data

Nov. 17, 1992 [JP] Japan ..... 4-307082

[51] Int. Cl.[6] ..... F04C 18/04

[52] U.S. Cl. ..... 418/55.5; 418/57; 418/151

[58] Field of Search ..... 418/55.5, 57, 151

[56] References Cited

U.S. PATENT DOCUMENTS

| | | | |
|---|---|---|---|
| 4,466,784 | 8/1984 | Hiraga | 418/151 |
| 4,580,956 | 4/1986 | Takahashi et al. | 418/151 |
| 4,824,346 | 4/1989 | Hiraga et al. | 418/57 |
| 5,201,646 | 4/1993 | Dees et al. | 418/55.5 |

FOREIGN PATENT DOCUMENTS

| | | |
|---|---|---|
| 2176179 | 7/1990 | Japan . |
| 449601 | 4/1992 | Japan . |

*Primary Examiner*—John J. Vrablik
*Attorney, Agent, or Firm*—Burgess, Ryan & Wayne

[57] ABSTRACT

A scroll type refrigerant compressor having a stationary scroll unit including a spiral member, a movable scroll unit including an orbiting spiral member engaged with the stationary spiral member to define gas-pocket-like variable-volume compression chambers in which the refrigerant gas is compressed in response to a rotation of a drive shaft having an eccentrically arranged drive key member, a drive bushing member having an aperture formed therein in which the drive key of the drive shaft is inserted so as to cause an eccentric motion of the drive bushing member which is operatively engaged with the movable spiral member of the movable scroll unit to thereby drive an orbiting motion of the movable spiral member, and a mechanical space-control unit for suppressing an uncontrolled play of the drive bushing member to thereby move the movable scroll unit in a correct orbiting path with respect to the stationary scroll unit.

7 Claims, 3 Drawing Sheets

SCROLL TYPE REFRIGERANT COMPRESSOR WITH MEANS FOR PREVENTING UNCONTROLLED MOVEMENT OF A DRIVE BUSHING

BACKGROUND OF THE INVENTION

1. Field of the Invention

The present invention relates to a scroll type refrigerant compressor, and more particularly relates to an improvement in the counterweight means and a drive bushing member accommodated therein.

2. Description of the Related Art

Japanese Unexamined Patent Publication (Kokai) No. 2-176179 discloses a typical scroll type refrigerant compressor provided with a stationary scroll unit fixedly encased in a housing means, and a movable scroll unit orbiting in the housing means so as to compress refrigerant gas in cooperation with the stationary scroll unit. The stationary scroll unit includes a stationary spiral member and an end plate member fixedly attached to an end of the spiral member and to the housing means. The stationary spiral member is formed as a wall member extending spirally along an involute curve with respect to a given point, i.e., a center of the stationary spiral member.

The movable scroll unit includes a movable spiral member engaged with the stationary spiral member and a movable end plate member fixed to an end of the movable spiral member on the side axially opposite to the end plate member of the stationary scroll unit. The movable spiral member, which is also formed as a wall member extending spirally along an involute curve with respect to a given point, i.e., a center of the movable spiral member is arranged so as to be circumferentially shifted from the stationary spiral member by 180°.

The scroll type refrigerant compressor is also provided with an axial drive shaft rotatably supported in the housing means and having a large diameter portion formed at an end thereof. The large diameter portion of the drive shaft is provided with an integral drive key member projecting axially from the end face thereof. The drive key member is formed as a part-cylindrical member having a central axis thereof radially shifted from the center of rotation of the drive shaft. The drive key member is provided with opposite planar faces extending in parallel with the central axis and two diametrically opposed circular faces. The planar faces of the drive key member are arranged on opposite sides with regard to a diametrical axis of the key member which extends perpendicularly to the above-mentioned central axis. The diametrical axis of the drive key member is inclined from a predetermined diametrical axis passing therethrough the axis of rotation of the drive shaft and the central axis of a later-described drive bushing member.

The axial drive shaft is also provided with a counterweight substantially integral with the large diameter portion of the drive shaft. The above-mentioned bushing member is provided with an aperture into which the part-cylindrical drive key member of the drive shaft is inserted in a manner such that the drive key member is able to slide in the diametrical axis thereof. The bushing member is engaged with the movable spiral member of the movable scroll unit via a bearing element so as to move the movable scroll unit in an orbiting path with regard to the stationary scroll unit. The movable scroll unit is, however, prevented from being rotated about the central axis thereof by an appropriate rotation preventing means such as described in U.S. Pat. No. 4,824,346.

The principle of operation of the described scroll type refrigerant compressor is well known. Namely, the rotation of the drive shaft is converted into the orbiting motion of the movable scroll unit in relation to the stationary scroll unit via the drive key member, the drive bushing member and the rotation preventing unit, and as a result, a gradual shifting of lines of contact between the spiral member of the stationary scroll unit and that of the movable scroll unit from radially outer portions of both units toward radially central portions of both units occurs. Therefore, refrigerant pockets are successively formed between the stationary scroll unit and the movable scroll unit and shifted gradually toward the center of both units while the volume thereof is reduced. Consequently, the refrigerant gas introduced initially through a refrigerant inlet port of the compressor into the refrigerant pockets is gradually compressed and eventually discharged from the refrigerant pockets toward a discharge chamber of the compressor via an outlet port formed in the end plate member of the stationary scroll unit.

During the orbiting motion of the movable scroll unit, the counterweight arranged around the drive shaft acts against a moment to which the bushing member is subjected due to the orbiting motion of the movable scroll unit to thereby absorb a dynamic unbalance acting on the bushing member.

Further, the drive bushing member is able to slide with respect to the drive key member of the drive shaft in the direction of the afore-mentioned diametrical axis of the drive key member so as to adjust the line contacts between the stationary and movable scroll units. Namely, when the drive bushing member is shifted toward a position increasing an amount of eccentricity with regard to the rotating center of the drive shaft, the radius of orbiting motion of the movable scroll unit is increased. Namely, the movable scroll unit is urged against the stationary scroll unit, and accordingly, a sealing of the refrigerant pockets in which the refrigerant gas is compressed is occurs.

The drive bushing member can be also shifted in the opposite direction to the above-mentioned eccentricity-increasing direction so as to decrease an amount of eccentricity thereof with regard to the rotating center of the drive shaft. Thus, it is possible to absorb a slight misalignment in the engagement of the stationary and movable scroll units as well as to avoid a collision of both units which occurs when the rotating direction of the compressor is reversed at the moment of stopping of the compressor or when any foreign materials enter into the interior of the compressor.

Nevertheless, in the above-described conventional scroll type refrigerant compressor, the aperture of the drive bushing member is formed as a through-hole, and the drive key member of the drive shaft is inserted in the through-hole type aperture of the bushing member in such a manner that an extreme end of the drive key member is projected from the aperture. A retaining ring element such as a conventional circular snap ring is attached to the extreme end of the drive key member to prevent withdrawal of the drive key member from the drive bushing member. However, the retaining ring is insufficient for preventing an uncontrolled movement of the drive bushing member with respect to the drive key member of the drive shaft. More specifically, since a given amount of axial spacing is left between the retaining ring or circular snap ring attached to the extreme end of the drive key member of the drive shaft and the end face of the drive bushing member, and since the aperture of the bushing member is formed so as to permit the sliding movement of the bushing member, the drive bushing member is uncontrollably inclined from a plane perpendicular to the axis of rotation of the drive shaft with respect to the drive key member of the drive shaft. Accordingly, the movable scroll unit operatively engaged with the drive bushing member must orbit at a posture thereof inclined away from a normal condition. Therefore, there occurs local abrasion of the stationary and movable scroll units during the operation of the compressor. Also, noise can be generated during orbiting of the movable scroll, due to the incorrect engagement of the scroll units.

Nevertheless, if the axial spacing between the retaining ring of the drive key member of the drive shaft and the end face of the drive bushing member is sufficiently reduced to prevent the above-mentioned local abrasions and generation of the noise, the drive key member of the drive shaft is unable to smoothly slide in the aperture of the drive bushing member to thereby cause a problem of incomplete radial sealing between the stationary and movable scroll units. Moreover, a minute positional discrepancy between the stationary and movable scroll units cannot be absorbed.

SUMMARY OF THE INVENTION

Therefore, a principal object of the present invention is to eliminate the problems encountered by the above-mentioned scroll type refrigerant compressor.

Another object of the present invention is to provide a scroll type refrigerant compressor having means for suppressing unfavorable play of the drive bushing member to thereby prevent a local abrasion of the stationary and movable scroll units while permitting a smooth adjusting movement of the drive bushing member with regard to the drive key member of the drive shaft.

In accordance with the present invention, there is provided a scroll type refrigerant compressor adapted for use in, for example, a vehicle refrigerating system comprising:

an axial housing unit forming an outer casing of the compressor and defining a refrigerant suction passageway, a discharge chamber and a chamber receiving therein a compressing unit, the housing unit having an axis thereof extending axially at a substantially center portion thereof;

a stationary scroll unit stationarily encased in the housing unit and including a fixedly arranged spiral member and an end plate attached to an end of the spiral member;

a movable scroll unit engaged with the stationary scroll unit and moving along a predetermined orbiting path with respect to the stationary scroll unit to thereby define compression chambers between both scroll unit;

a drive shaft supported in the housing unit via bearing unit so as to be rotated about an axis of rotation thereof, and having an axial shaft portion and a large diameter portion formed at an innermost portion of the axial shaft portion;

a drive key member projecting from an end of the large diameter portion of the drive shaft and formed as an axial part-cylindrical mechanical member eccentrically arranged at a position distant from the axis of rotation of the drive shaft and having planar faces disposed on both sides of a diametrical axis thereof which is slanted by a given angle with regard to a predetermined axis in a direction reverse to the rotating direction of the drive shaft;

a drive bushing member slidably engaged with the drive key member of the drive shaft and operatively engaged with the spiral member of the movable scroll unit via a bearing unit, the drive bushing member giving an orbiting motion to the movable scroll unit in cooperation with a unit for preventing rotation of the movable scroll unit about its own central axis during rotation of the drive shaft;

a counterweight member arranged around the drive key member so as to eliminate a dynamic unbalance acting on the movable scroll unit during the orbiting motion thereof;

the stationary scroll unit, the movable scroll unit, the axial drive shaft, the drive key member, and the drive bushing member forming the compressing unit successively compressing the refrigerant gas in the compression chambers; and, a unit for preventing the drive bushing member from performing an uncontrolled play including an inclining motion of the drive bushing member from a plane generally perpendicular to the axis of rotation of the drive shaft with respect to the drive key member.

Preferably, the drive bushing member is provided with a through-hole like aperture formed therein in which the drive key member is inserted in such a manner that an innermost end of the drive key member is axially projected from an end face of the drive bushing member, and a retaining member is arranged at the innermost end of the drive key member so as to prevent withdrawal of the drive key member from the drive bushing member.

Then, the unit for preventing the drive bushing member from performing an uncontrolled play comprises a preloaded elastic unit disposed between the retaining unit of the drive key member of the drive shaft and the end face of the drive bushing member.

The preloaded elastic unit comprises at least one disc spring element and a washer element seated against the end face of the drive bushing member.

Further, when the drive bushing member of the scroll type refrigerant compressor is provided with a through-hole like aperture formed therein in which the drive key member is inserted in such a manner that an innermost end of the drive key member is axially projected from an end face of the drive bushing member, and when a nut unit is threadedly engaged with an threaded portion formed at the innermost end of the drive key member so as to prevent withdrawal of the drive key member from the drive bushing member, and a thrust bearing unit may preferably be arranged between the nut unit of the drive key member and the end face of the drive bushing member, the thrust bearing unit being preloaded by the nut unit and slidable in a direction corresponding to the diametrical axis of the drive key member.

The thrust bearing unit preferably comprises a planar member and a plurality of needle elements arranged so as to be able to slide in the direction corresponding to the diametrical axis of the drive key member.

BRIEF DESCRIPTION OF THE DRAWINGS

The above and other objects, features and advantages of the present invention will be made more apparent from the ensuing description of preferred embodiments thereof in conjunction with the accompanying drawings wherein.

DESCRIPTION OF THE PREFERRED EMBODIMENTS

Figure 1:
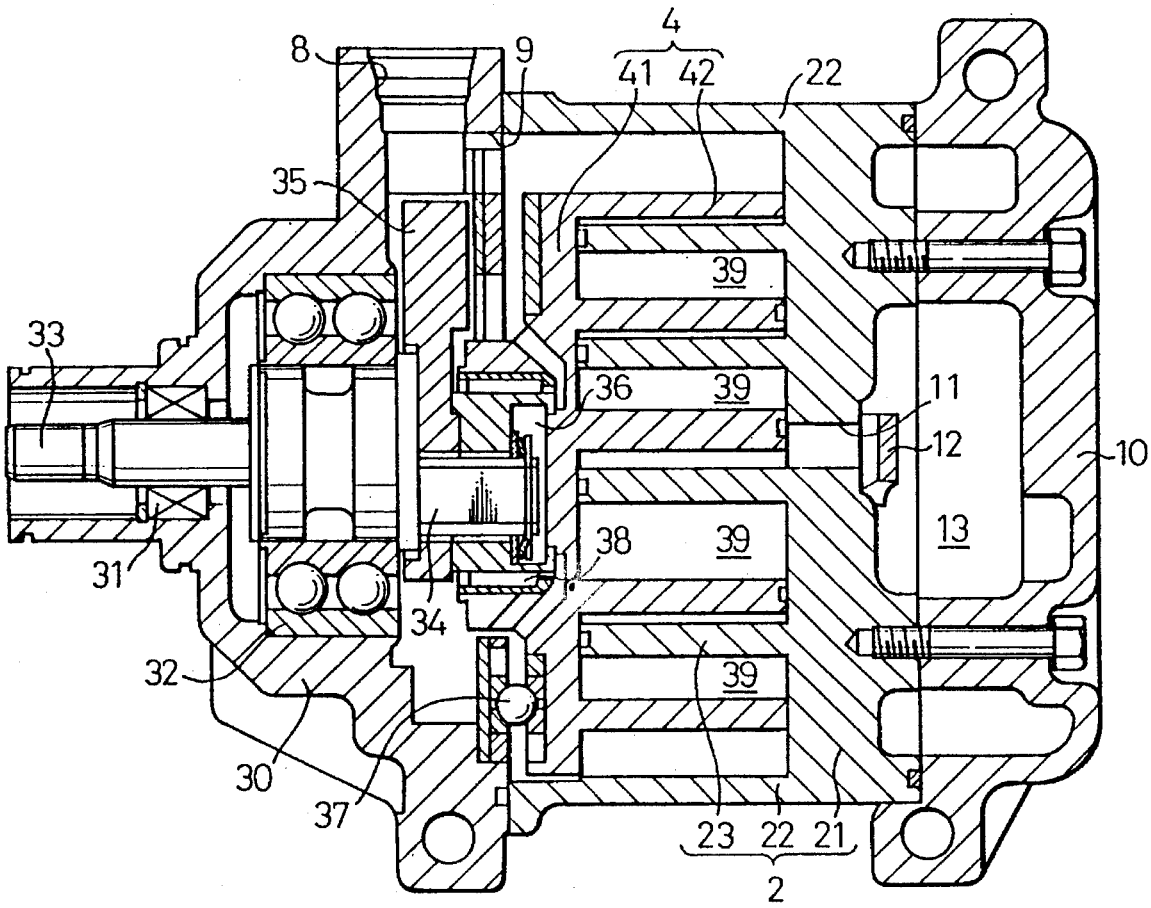
FIG. 1 is a longitudinal cross-sectional view of a scroll type refrigerant compressor in which an improvement according to the present invention is applied.
Figure 2:
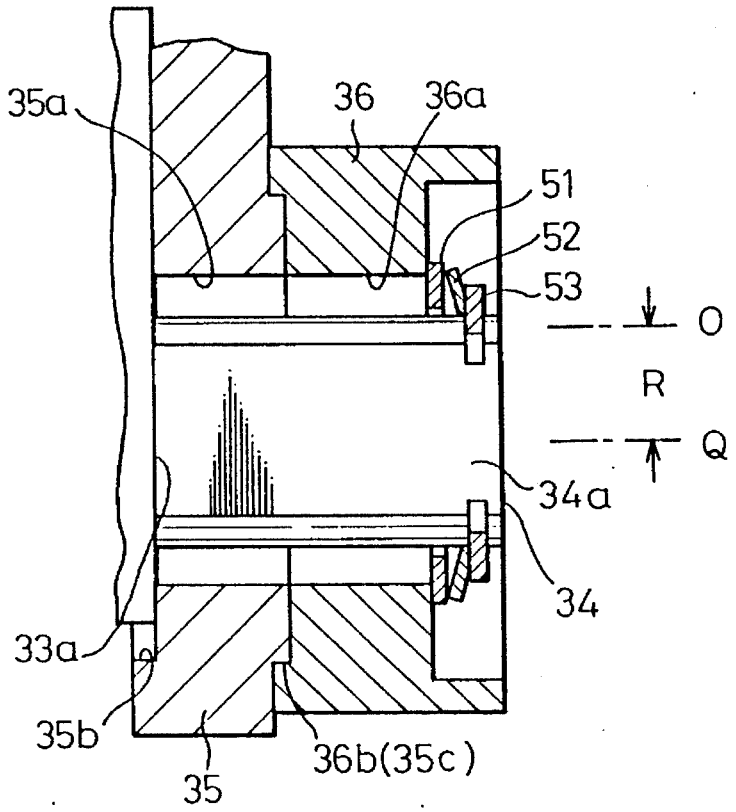
FIG. 2 is a cross-sectional view of an important portion, i.e., an engaged portion of the drive key member and the drive bushing member accommodated in the compressor of FIG. 1, according to a first embodiment of the present invention.
Figure 3:
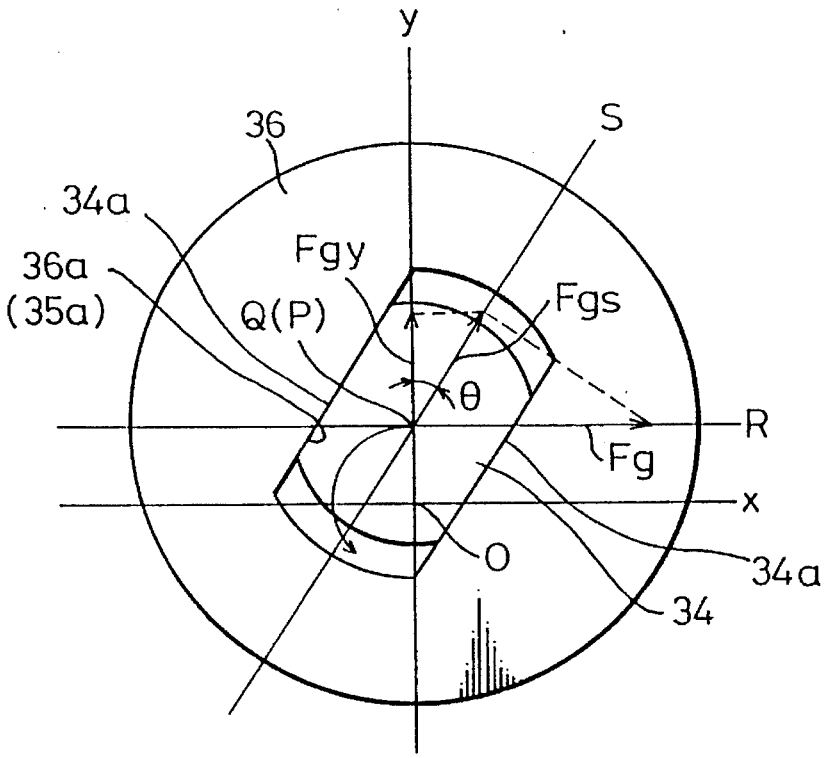
FIG. 3 is a schematic front view of the important portion of the compressor of FIG. 1.

Referring to FIGS. 1 through 3, the scroll type refrigerant compressor according to the present invention is provided with a housing including a front housing member 30, a rear housing member 10 and a middle housing portion arranged between the front and rear housing members 30 and 10. The compressor is also provided with a stationary end plate 21 fixedly attached to an inner face of the rear housing 10, and a shell member 22 formed so as to be integral with the stationary end plate 21 and forming the middle housing of the compressor. The compressor is further provided with a stationary spiral member 23 in the form of an spirally extending wall member integral with the stationary end plate 21. The stationary spiral member 23 may extend along e.g., an involute curve with respect to a given central axis in parallel with a longitudinal axis of the housing of the compressor. The stationary end plate 21, the shell member 22, and the stationary spiral member 23 forms a stationary scroll unit 2 of the compressor.

The compressor is further provided with a movable scroll unit 4 including a movable end plate 41 disposed to be axially opposed to the stationary end plate 2.1, and a movable spiral member 42 formed as a wall member extending along, e.g., an involute curve about a given axis thereof. The movable spiral member 42 is attached to an inner face of the movable end plate 41. The movable scroll unit 4 is engaged with the stationary scroll unit 2 so as to define refrigerant pockets functioning as compression chambers 39.

The front housing 30 fixedly combined with the shell member 22 of the stationary scroll unit 2 has a central bore in which an axial drive shaft 33 is supported by means of a shaft seal member 31 and a rotary bearing 32. The drive shaft 33 has an axis of rotation thereof designated by "O" in FIG. 2, and a large diameter portion formed at an inner portion thereof which is fitted in the inner bore of the rotary bearing 32. The large diameter portion of the drive shaft 33 has an inner end face **33*a* from which a drive key or slide key member 34 axially projects toward an interior of the compressor. The drive key member 34 is formed as a part-cylindrical projection having a central axis "P" ( FIG. 3) and a diametrical axis "S" intersecting the central axis and slanted in a direction reverse to a predetermined rotating direction of the drive shaft 33. The drive key member 34 is provided with a pair of planar faces 34*a*** extending in parallel with the central axis thereof and disposed on opposite sides of the diametrical axis thereof.

A counterweight member 35 is arranged around the drive key member 34 and adjacent to the inner end face **33*a* of the large diameter portion of the drive shaft 33. Namely, the counterweight 35 is provided with a counterbore 35*b* bored about an axis coaxial with the central axis "O" of the drive shaft 33 in an end face thereof confronting the inner end face 33*a* of the drive shaft 33, and the counterbore 35*b* of the counterweight 35 receives the end face 34*a* of the drive shaft 33 as shown in FIG. 2. Since the diameter of the counterbore 35*b* of the counterweight 35 is larger than that of the large diameter portion of the drive shaft 33, and since the counterweight 35 is also provided with a through-bore 35*a* elongated in the direction corresponding to the diametrical axis "S" and having a pair of planar inner walls in contact with the planar faces 34*a* of the drive key 34, the counterweight 35 per se can adjustably move with respect to the drive key member 34 in a predetermined radial direction under the guidance of the planar faces 34*a* of the drive key member 34**.

The drive bushing member 36 is provided with a counterbore **36*b* formed in an end face thereof confronting the counterweight 35 about a central axis designated by "Q" in FIGS. 2 and 3. The counterbore 36*b* of the drive bushing member 36 receives a corresponding cylindrical protrusion 35*c* of the counterweight 35 which is formed about the same central axis "Q". Thus, the counterweight 35 and the drive bushing member 36** are axially engaged.

The drive bushing member 36 is also provided with an aperture **36*a* in the same form as the through-bore 35*a* of the counterweight 35 as shown in FIG. 3 so that the drive key member 34 of the drive shaft 33 is inserted therein. Accordingly, the drive bushing member 36 can move together with the counterweight 35 in the predetermined radial direction under the guidance of the planar faces 34*a* of the drive key member 34**.

The drive key member 34 of the drive shaft 33 is provided with an end portion located adjacent to a counterbored inner end face of the drive bushing member 36. The end portion of the drive key member 34 is provided with a washer member 51 mounted thereon in a loose-fitting manner and seated against the bottom face of the counterbore of the drive bushing member 36. The end portion of the drive shaft 33 is also provided with a retaining ring 53 such as a conventional circlip fitted in a groove formed in the innermost end of the drive key member 34, and a disc spring 52 supported by the retaining ring 53. The disc spring 52 is disposed at a preloaded condition so as to define a limited optimum spacing between the washer member 51 and the retaining ring 53. The disc spring 52 may be replaced with other appropriate elastic means which can be preloaded.

The drive bushing member 36 is a generally cylindrical member having a central axis thereof coaxial with the central axis "Q" of the key member 234, and is engaged with the movable spiral member 42 of the movable scroll unit 4 via a bearing 38, in order to drive the orbiting motion of the movable scroll unit 4 in cooperation with a rotation preventing means 37 (FIG. 1 ) which is provided for preventing rotation of the movable scroll unit 4 about its own central axis.

As best shown in FIG. 1, the front housing 30 is provided with an inlet port 8 which is communicated with an outer refrigerating circuit. The position of the inlet port 8 is in radial registration with the outer circumference of the counterweight 35, and is fluidly communicated with a refrigerant suction passageway 9 extending so as to pierce the front housing 30 and a part of the above-mentioned rotation preventing means 37. The refrigerant suction passageway 9 is routed so as to pass by the outer circumference of the counterweight 35, and is in direct fluid communication with the compression chambers 39 of the movable scroll unit 4.

The stationary end plate 21 of the stationary scroll unit 2 is provided with a discharge port 11 formed at a center thereof so as to be communicated with the compression chamber 39 at the final stage of compression of the refrigerant gas. The discharge port 11 is also communicated with a discharge chamber 13 formed inside the rear housing 10 via a discharge valve 12 in the form of a check valve. The discharge chamber 13 of the rear housing 10 is communicatable with an outer refrigerating circuit via a non-illustrated outlet port. Namely, the compressed refrigerant gas is discharged from the discharge chamber 13 through the outlet port toward the outer refrigerating circuit.

The scroll type refrigerant compressor of FIG. 1 is adapted for use in a vehicle refrigerating system, and therefore, when the drive shaft 33 is connected to a vehicle engine via a non-illustrated solenoid clutch. When the drive shaft 33 is rotated, the drive key member 34 is also rotated about the central axis "O". Therefore, the drive bushing member 36 together with the counterweight 35 is rotated about the same central axis "O", and accordingly, as the movable scroll unit 4 is prevented by the rotation preventing means 37 from being rotated about its own central axis, the unit 4 is moved along an orbiting path about the central axis "O" of the drive shaft 33 at a radius corresponding to an amount of eccentricity "R". The orbiting motion of the movable scroll unit 4 causes gradual shifting of the compression chambers 339 formed by the stationary end plate and spiral members 21 and 22 of the stationary scroll unit 2, and the movable end plate and spiral members 4 1 and 42 of the movable scroll unit 4 from the radially outer portion of both scroll units 2 and 4 toward the center of both scroll units 2 and 4. During the shifting of each of the compression chambers 339, the volume thereof is gradually reduced. Thus, the refrigerant gas sucked from the inlet port 8 and the suction passageway 9 into the compression chambers 339 is gradually compressed therein. When each of the compression chambers 339 is shifted to the central portion of both scroll units 2 and 4, the compressed refrigerant gas is discharged from the compression chambers 339 toward the discharge chamber 133 via the outlet port 11 and the discharge valve 12. At this stage, the counterweight 335 counteracts an eccentric moment acting on the drive bushing member 336 from the movable scroll unit 4. Thus, the dynamic unbalance acting on the movable scroll unit 4 is absorbed by the counterweight 335.

In the described scroll compressor, the counterweight 335 together with the drive bushing member 336 can be shifted radially with respect to the drive key member 334 as shown in FIG. 33. Namely, the counterweight 335 and the drive bushing member 336 can be moved by a drive force of the drive key member 334 of the drive shaft 33 to increase the amount of eccentricity "R" of the drive bushing member 336. Thus, when an orthogonal coordinate system (X-axis and Y-axis), and a linear line "R" are defined as shown in FIG. 33, a counter force Fg of the compression of the refrigerant gas acts in a direction parallel with the line "R". Therefore, a component force Fgs (= Fg×sin Ø ) acts along the diametrical axis "S" of the drive key member 34. The force component "Fgs" urges the counterweight 335 and the drive bushing member 336 toward a position capable of increasing the amount of eccentricity "R" of the two members 35 and 36.

When the eccentricity "R" is increased, a force component Fgy (= Fg×sin Ø×cos Ø ) acting along the Y-axis urges the movable spiral member 42 of the movable scroll unit 4 against the stationary spiral member 22 of the stationary scroll unit 2, and therefore the sealing of the compression chambers 39 in the radial direction is enhanced.

The counterweight 35 and the drive key member 36 can be shifted in the direction decreasing the amount of eccentricity "R". Therefore, the drive bushing member 36 is able to function so as to compensate for a minute positional discrepancy between the stationary and movable scroll units 2 and 4. Further, when the rotating direction of the movable scroll unit 4 is reversed due to a stopping of the compressor or intrusion of any foreign matters into the interior of the compressor, the slight shifting of the counterweight 35 and the drive bushing member 36 prevents an excessive load is applied thereto. Consequently, during the operation of the compressor, collision of the stationary and movable scroll units 2 and 4 can be always avoided.

The washer member 51 is seated against the bottom face of the counterbore formed in the innermost end face of the drive bushing member 36 by the spring force of the disc spring 52. Accordingly, when the disc spring 52 is set at an appropriate preloaded condition, the spacing left between the washer member 51 and the retaining ring 53 fixed to the drive key member 34 is maintained at a constant optimum value, and therefore the drive bushing member 36 can be prevented from having an uncontrolled play with respect to the drive key member 34. Namely, the drive bushing member 36 is not permitted by the elastic force exerted by the disc spring 52 to move from a plane perpendicular to the central axis "0." of the drive key member 34 of the drive shaft 33, and is permitted only to slide in a direction along the diametrical axis "S" thereof with regard to the drive key member 34 by the use of the through-hole like aperture **36*a* and under the guidance of the planar faces 34*a* of the drive key member 34 to thereby adjust the radius of the orbiting motion of the movable scroll unit 4**.

Thus, in the described scroll type refrigerant compressor according to the first embodiment, the orbiting motion of the movable scroll unit 4 with respect to the stationary scroll unit 2 can be appropriately controlled. Accordingly, during the operation of the compressor, the stationary and movable scroll units 2 and 4 can perform suction, compression, and discharge of the refrigerant gas maintaining a theoretically normal engagement of the two spiral members 23 and 42. Consequently, local abrasion of the mutually engaged stationary and movable scroll units 2 and 4 and a colliding contact of both units can be prevented. Accordingly, the operating life of the two scroll units 2 and 4 can be increased thus enhancing the reliability of the whole compressor.

Further, the provision of the washer member 51 can contribute to providing the drive bushing member 36 with a constant and appropriate elastic force enabling a smooth sliding motion of the drive bushing member 36 with respect to the drive key member 34. Thus, the radius of orbiting motion of the movable scroll unit 4 can be constantly controlled so as to obtain an engagement of the two spiral members 23 and 42 most suitable for sealing the compression chambers 39. Consequently, a high compression efficiency can be realized without generating noise.

It should be understood that the described disc spring 52 arranged for setting an appropriate elastic force applied to the drive bushing member 36 may be replaced with other appropriate elastic means, such as a rubber plate or plates disposed between the bottom face of the counterbore of the drive bushing member 36 and the retaining ring 53 fixed to the drive key member 34.

Figure 4:
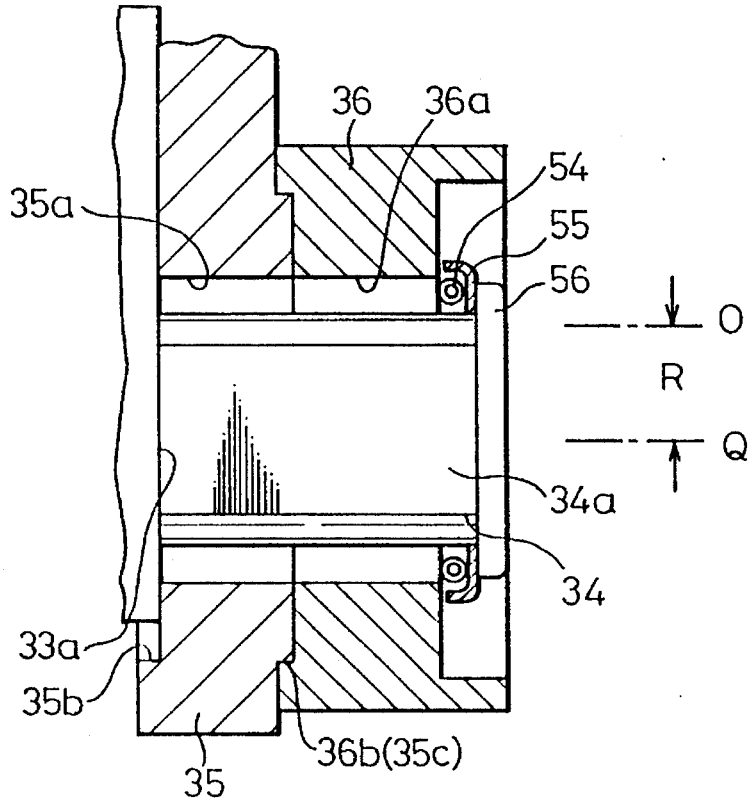
FIG. 4 is a similar view to FIG. 2, illustrating an engaged portion of the drive key member and the drive bushing member according to a second embodiment of the present invention; and, FIG. 5 is a schematic front view of the engaged portion of the drive key member and the drive bushing member of FIG. 4.
Figure 5:
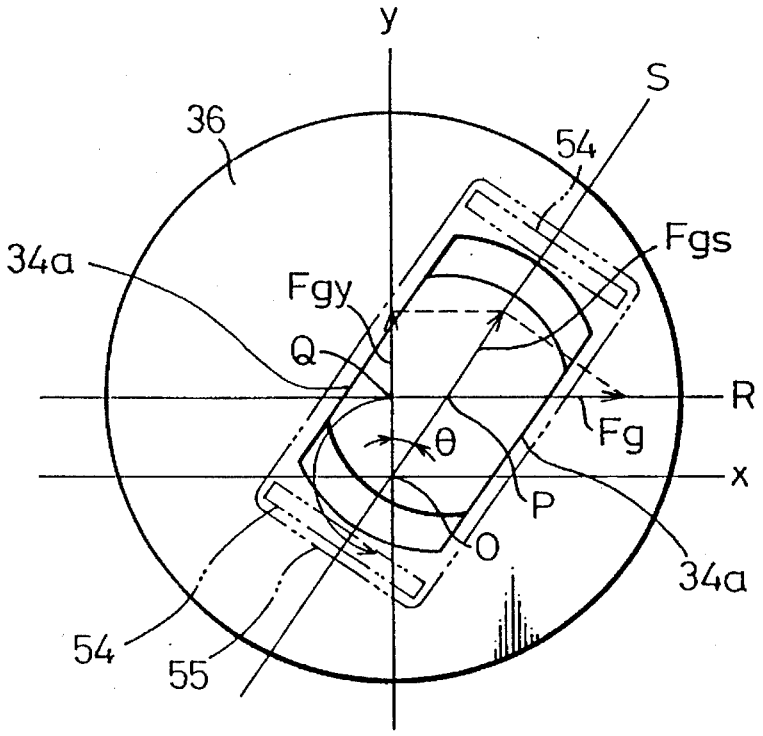

FIGS. 4 and 5 illustrate a second embodiment of the present invention in which a thrust bearing member is provided for establishing an appropriate spacing between the inner end face of the drive bushing member 36 and the innermost end of the drive key member 34 which is inserted in the through-bore like apertures 35*a* and 36*a* of the counterweight 35 and the drive bushing member 36.

Namely, the thrust bearing is arranged adjacent to a nut member 56 which is threadedly engaged with a male screw portion formed at the innermost end of the drive key member 34 and includes a planar plate member 55 and two needle elements 54. The planar plate member 55 has two curved ends spaced apart from each other in the direction of the diametrical axis "S" shown in FIG. 5. The needle elements 54 have a length longer than the width of the through-hole like aperture 36*a* of the drive bushing member 36, respectively, and also have a rolling axis, respective, extending perpendicularly to the diametrical axis "S" of the drive key member 34. The planar plate member 55 made of a thin metallic material having an appropriate elasticity is pressed by the nut member 56 toward the bottom face of the counterbore of the drive bushing member 36, when the nut member 56 is threadedly tightened.

The other construction of the scroll type refrigerant compressor according to the second embodiment is similar to that of the first embodiment.

In the described compressor of the second embodiment, when the nut member 56 is tightened against the drive key member 34 so as to set an optimum preload condition for the planar plate member 55, an ideal small spacing can be established between the bottom face of the counterbore of the drive bushing member 36 and the innermost end of the drive key member 34. Accordingly, the drive bushing member 36 is not permitted to perform an uncontrolled play with respect to the drive key member 34 of the drive shaft 33.

In addition, the needle elements 54 permits the drive bushing member 36 to smoothly slide in the direction along the diametrical axis "S" of the key member 34. Thus, the drive bushing member 36 can adjust the radius of orbiting motion of the scroll unit 4 so that an appropriate engagement of the stationary and movable scroll units 2 and 4 is constantly maintained. Thus, a gas-tight seal for the compression chambers 39 (FIG. 1) formed by both scroll units 2 and 4 can be ensured to prevent a leakage of the compressed gas from the compression chambers 39.

In the second embodiment, the though-hole like aperture 36*a* of the drive bushing member 36 is formed at a position slightly shifted from the central axis "Q" of the drive bushing member 36, and therefore, the drive key member 34 of the drive shaft 33 is formed so that the central axis "P" thereof is situated on the line "R" passing through the central axis "Q" of the drive bushing member 36. Nevertheless, the gas-sealing effect achieved by the smooth slide of the drive bushing member 36 together with the counterweight 35 is quite similar to that of the first embodiment.

From the foregoing description of the preferred embodiments of the present invention, it will be understood that the scroll type compressor of the present invention can exhibit an improved performance such as a long operational durability and a reliable operation of the stationary and movable scroll units, an enhanced sealing of the compression chambers during the operation of the compressor, a noise free operation of the scroll units, and a high compression efficiency.

It should, however, be understood that various changes and modifications will occur to persons skilled in the art without departing from the scope and spirit of the present invention defined by the accompanying claims.

We claim:

1. A scroll type refrigerant compressor adapted for use in a vehicle refrigerating system comprising:

an axial housing means forming an outer casing for the compressor and defining a refrigerant suction passage means, a discharge chamber and a compression organizing chamber receiving therein a compressing means, said housing means having an axis thereof extending axially at a substantially center portion thereof;

a stationary scroll means stationarily encased in said housing means and including a stationary spiral member and a stationary end plate member attached to an end of said spiral member;

a movable scroll means engaged with said stationary scroll means and moving along a predetermined orbiting path with respect to said stationary scroll means, to thereby define compression chambers between both scroll means;

a drive shaft supported in said housing means via a bearing means so as to be rotated about an axis of rotation thereof, and having an axial shaft portion and a large diameter portion formed at an innermost portion of said axial shaft portion;

a drive key member projecting from an end of said large diameter portion of said drive shaft and formed as an axial part-cylindrical mechanical member eccentrically arranged at a position distant from the axis of rotation of said drive shaft and having planar faces disposed on both sides of a diametrical axis thereof which is angularly shifted by a predetermined angle with regard to a predetermined axis in a direction reverse to the rotating direction of said drive shaft;

a drive bushing member slidably engaged with said drive key member of said drive shaft and operatively engaged with said movable scroll means via a bearing means, said drive bushing member driving an orbiting motion of said movable scroll means in cooperation with means for preventing rotation of said movable scroll means about its own central axis during rotating of said drive shaft, and said drive bushing member being provided with a through-hole like aperture formed therein with planar faces and being longer than the drive key member along said diametrical axis and in which said drive key member is inserted so that the planar faces of the drive key member face the planar faces of said aperture and an innermost end of said drive key member is axially projected from an end face of said drive bushing member;

a counterweight member arranged around said drive key member so as to eliminate a dynamic unbalance acting on said movable scroll means during the orbiting motion thereof;

a retaining means arranged at said innermost end of said drive key member so as to prevent withdrawal of said drive key member from said drive bushing member;

said stationary scroll member, said movable scroll means, said axial drive shaft, said drive key member, and said drive bushing member forming said compressing means successively compressing the refrigerant gas in said compression chambers; and means for preventing said drive bushing member from having uncontrolled play including a motion of said drive bushing member from a plane generally perpendicular to said axis of rotation of said drive shaft with respect to said drive key member, said means for preventing said drive bushing member from having uncontrolled play comprising a preloaded means disposed between said retaining means of said drive key member of said drive shaft and said end face of said drive bushing member.

2. A scroll type refrigerant compressor adapted for use in, for example, a vehicle refrigerating system comprising:

an axial housing means forming an outer casing of the compressor and defining a refrigerant suction passage means, a discharge chamber and a compression organizing chamber receiving therein a compressing means, said housing means having an axis thereof extending axially at a substantially center portion thereof;

a stationary scroll means stationarily encased in said housing means and including a stationary spiral member and a stationary end plate member attached to an end of said spiral member;

a movable scroll means engaged with said stationary scroll means and moving along a predetermined orbiting path with respect to said stationary scroll means, to thereby define compression chambers between both scroll means;

a drive shaft supported in said housing means via a bearing means so as to be rotated about an axis of rotation thereof, and having an axial shaft portion and a large diameter portion formed at an innermost portion of said axial shaft portion;

a drive key member projecting from an end of said large diameter portion of said drive shaft and formed as an axial part-cylindrical mechanical member eccentrically arranged at a position distant from the axis of rotation of said drive shaft and having planar faces disposed on both sides of a diametrical axis thereof which is angularly shifted by a predetermined angle with regard to a predetermined axis in a direction reverse to the rotating direction of said drive shaft;

a drive bushing member slidably engaged with said drive key member of said drive shaft and operatively engaged with said movable scroll means via a bearing means, said drive bushing member driving an orbiting motion of said movable scroll means in cooperation with means for preventing rotation of said movable scroll means about its own central axis during rotating of said drive shaft, and said drive bushing member being provided with a through-hole like aperture formed therein with planar faces and being longer than the drive key member along said diametrical axis and in which said drive key member is inserted in such a manner that the planar faces of the drive key member face the planar faces of said aperture and an innermost end of said drive key member is axially projected from an end face of said drive bushing member;

a counterweight member arranged around said drive key member so as to eliminate a dynamic unbalance acting on said movable scroll means during the orbiting motion thereof;

a retaining means arranged at said innermost end of said drive key member so as to prevent withdrawal of said drive key member from said drive bushing member;

said stationary scroll means, said movable scroll means, said axial drive shaft, said drive key member, and said drive bushing member forming said compressing means successively compressing the refrigerant gas in said compression chambers; and means for preventing said drive bushing member from having uncontrolled play including a motion of said drive bushing member from a plane generally perpendicular to said axis of rotation of said drive shaft with respect to said drive key member, said means for preventing said drive bushing member from having uncontrolled play comprising a preloaded elastic means disposed between said retaining means of said drive key member of said drive shaft and said end face of said drive bushing member.

3. A scroll type refrigerant compressor according to claim 2, wherein said preloaded elastic means comprises at least one disc spring element and a washer element seated against said end face of said drive bushing member.

4. A scroll type refrigerant compressor according to claim 2, wherein said counterweight means comprises a counterweight member separate from said drive bushing member and assembled to be integral with said bushing member, said counterweight member being radially slidable with respect to said drive key member together with said drive bushing member.

5. A scroll type refrigerant compressor adapted for use in, for example, a vehicle refrigerating system comprising:

an axial housing means forming an outer casing of the compressor and defining a refrigerant suction passage means, a discharge chamber and a compression organizing chamber receiving therein a compressing means, said housing means having an axis thereof extending axially at a substantially center portion thereof;

a stationary scroll means stationarily encased in said housing means and including a stationary spiral member and a stationary end plate member attached to an end of said spiral member;

a movable scroll means engaged with said stationary scroll means and moving along a predetermined orbiting path with respect to said stationary scroll means, to thereby define compression chambers between both scroll means;

a drive shaft supported in said housing means via a bearing means so as to be rotated about an axis of rotation thereof, and having an axial shaft portion and a large diameter portion formed at an innermost portion of said axial shaft portion;

a drive key member projecting from an end of said large diameter portion of said drive shaft and formed as an axial part-cylindrical mechanical member eccentrically arranged at a position distant from the axis of rotation of said drive shaft and having planar faces disposed on both sides of a diametrical axis thereof which is angularly shifted by a predetermined angle with regard to a predetermined axis in a direction reverse to the rotating direction of said drive shaft;

a drive bushing member slidably engaged with said drive key member of said drive shaft and operatively engaged with said movable scroll means via a bearing means, said drive bushing member driving an orbiting motion of said movable scroll means in cooperation with means for preventing rotation of said movable scroll means about its own central axis during rotating of said drive shaft, and said drive bushing member being provided with a through-hole like aperture formed therein with planar faces and being longer than the drive key member along aid diametrical axis and in which said drive key member is inserted in such a manner that the planar faces of the drive key member face the planar faces of said aperture and an innermost end of said drive key member is axially projected from an end face of said drive bushing member;

a counterweight member arranged around said drive key member so as to eliminate a dynamic unbalance acting on said movable scroll means during the orbiting motion thereof;

a nut means threadedly engaged with a threaded portion formed at said innermost end of said drive key member so as to prevent withdrawal of said drive key member from said drive bushing member;

said stationary scroll means, said movable scroll means, said axial drive shaft, said drive key member, and said drive bushing member forming said compressing means successively compressing the refrigerant gas in said compression chambers; and means for preventing said drive bushing member from having uncontrolled play including a motion of said drive bushing member from a plane generally perpendicular to said axis of rotation of said drive shaft with respect to said drive key member, said means for preventing said drive bushing member from having uncontrolled play comprising a thrust bearing means arranged between said nut means of said drive key member and said end face of said drive bushing member, said thrust bearing means being preloaded by said nut means and slidable in a direction corresponding to said diametrical axis of said drive key member.

6. A scroll type refrigerant compressor according to claim 5, wherein said thrust bearing means comprises an planar plate member and a plurality of needle elements arranged so as to be able to slide in the direction corresponding to said diametrical axis of said drive key member.

7. A scroll type refrigerant compressor according to claim 5, wherein said counterweight means comprises a counterweight member separate from said drive bushing member and assembled to be integral with said bushing member, said counterweight member being radially slidable with respect to said drive key member together with said drive bushing member.

* * * * *